United States Patent [19]

Ono et al.

[11] Patent Number: 4,587,453

[45] Date of Patent: May 6, 1986

[54] LOW-PRESSURE MERCURY VAPOR DISCHARGE LAMP

[75] Inventors: Tetsuo Ono, Kokubunji; Yoshio Watanabe, Tokyo; Hiromitsu Matsuno, Hachioji; Yasuo Kato, Zama; Seiichi Murayama, Kokubunji; Shigeo Mikoshiba, Tokyo, all of Japan

[73] Assignee: Hitachi, Ltd., Tokyo, Japan

[21] Appl. No.: 516,913

[22] Filed: Jul. 25, 1983

[30] Foreign Application Priority Data

Jul. 30, 1982 [JP] Japan ..... 57-131935

[51] Int. Cl.[4] ..... H01J 61/34; H01J 61/52

[52] U.S. Cl. ..... 313/25; 313/493; 313/609; 313/634

[58] Field of Search ..... 313/609, 611, 612, 634, 313/493, 25

[56] References Cited

U.S. PATENT DOCUMENTS

| | | | |
|---|---|---|---|
| 4,199,708 | 4/1980 | Lauwerijssen et al. | 313/493 |
| 4,383,200 | 5/1983 | Van Zon et al. | 313/634 X |
| 4,389,595 | 6/1983 | Kamei et al. | 313/493 X |

*Primary Examiner*—David K. Moore
*Assistant Examiner*—K. Wieder
*Attorney, Agent, or Firm*—Antonelli, Terry & Wands

[57] ABSTRACT

A low-pressure mercury vapor discharge lamp comprising an envelope forming a gas-tight closed space and a pair of inner tubes provided in the closed space and having an end thereof sealed at the first end of the outer envelope, the other end thereof being opened into the closed space, and electrodes provided at the sealed end sides in the inner tubes. The temperature of the coldest spot of the envelope is in a range between 45° C. and 65° C. at an ambient temperature of 25° C.

5 Claims, 5 Drawing Figures

LOW-PRESSURE MERCURY VAPOR DISCHARGE LAMP

BACKGROUND OF THE INVENTION

The present invention relates to an improvement in a low-pressure mercury vapor discharge lamp, and, more particularly, to a low-pressure mercury vapor discharge lamp having an envelope of a double tube structure which is high in luminous efficacy.

Recently, there has been considerable efforts to provide a fluorescent lamp with a base which is capable of being held and turned on in a socket for the conventional incadescent lamp so as to provide what is called the compact fluorescent lamp.

For example, in U.S. Pat. No. 4,199,708, as shown in FIG. 1, a compact fluorescent lamp having a double tube envelope structure is proposed, comprising a closed lamp envelope 1 and a pair of inner tubes 3, 3' encased in the envelope 1, with an end thereof connected to one end 2 of the envelope 1, the other end thereof being opened into the envelope 1 at openings 7, 7'. The closed lamp envelope 1 is filled with a rare gas of several Torr and a small quantity of mercury, which are adapted to discharge between the electrodes 5, 5' respectively arranged within the inner tubes 3 and 3' whereby ultraviolet rays are generated and converted into a visible radiation by phosphors 4, 4' coated on the inner surface of the inner tube 3, 3'.

In order to prevent the dazzle of radiation of the inner tubes 3, 3', a light-dispersing layer 6 is provided on the inner surface of the closed envelope 1. An operating circuit is disposed in a lamp base 8 having an end provided with a suitable threaded sleeve 9.

Generally, the efficacy of a fluorescent lamp depends on the density N of mercury atoms in the discharge lamp envelope. More particularly, a relationship between the density N of mercury atoms and the partial pressure P of mercury may be expressed as follows:

$$P=kNT \quad (1)$$

where: k is Boltzmann's constant and T the absolute temperature.

The partial pressure P of mercury coincides with the saturated vapor pressure of mercury at the coldest spot of the discharge lamp. In ordinary fluorescent lamps, the temperature of the coldest spot of the discharge lamp is substantially the same as the glass wall temperature T of the portion where plasma exists, so that the density of mercury atoms in the discharge lamp is almost uniform. The density Nmax of mercury atoms maximizing the efficacy of a fluorescent lamp, which depends on the diameter of the discharge lamp, is generally known to be $1.5\times10^{14}$ $cm^{-3}$ to $3\times10^{14}$ $cm^{-3}$ (which corresponds to the temperature of the coldest tube spot set to 37° C. to 44° C.). Applied Optics Vol. 15, No. 1, 1976, pp 64 to 68).

In the case where the temperature of the coldest spot of the compact fluorescent lamp shown in FIG. 1 is maintained in the above-mentioned temperature range, however, the luminous efficacy of the lamp becomes so low that the lamp cannot be used practically. The luminous efficacy of the lamp is reduced especially when the lamp is intended for high output. This inconvenience is required to be obviated in some ways.

SUMMARY OF THE INVENTION

Accordingly, it is the object of the present invention to provide a low-pressure mercury vapor discharge lamp having a double tube structure which is high in luminous efficacy even at the time of high-output operation.

In order to achieve the above-mentioned object, according to the present invention a low-pressure mercury vapor discharge lamp is provided which comprises an envelope forming an enclosed space, a pair of inner tubes having an end sealed at one end of the lamp envelope and the other end opened into the enclosed space, and electrodes provided at the sealed end in the inner tubes, wherein the coldest spot of the envelope is set in the temperature range from 45° C. to 65° C. at the ambient temperature of 25° C.

The novel construction of the present invention is capable of providing a low-pressure mercury vapor discharge lamp of a double tube structure which operates at high luminous efficacy even at the time of high output operation.

Specifically, the present invention has been developed on the basis of the concept described below.

In the lamp having the construction shown in FIG. 1, it is well known that the mercury vapor pressure in the inner tubes 3, 3' depends on the temperature of the coldest spot of the enclosed envelope 1 in view of the fact that the space in the inner tubes 3, 3' communicates with the space in the enclosed envelope 1 through openings 7, 7'.

Fluorescent lamps of this type, which are intended for substitute for an incandescent lamp, are generally required to be small in size and have a high luminous efficacy. A great roadblock in the way of fulfillment of this requirement is the reduction in efficacy caused by the fact that the lamp temperature exceeds the optimum temperature level of the coldest spot. In the lamp of the construction shown in FIG. 1, also, the temperature of the coldest spot thereof increases with an increase of lamp power and exceeds the optimum value at a certain point, thus reducing the luminous efficacy. In order to attain a high output, therefore, the control of the mercury vapor pressure, that is, the temperature control of the coldest spot of the envelope is indispensable. Under the circumstances, however, the optimum temperature of the coldest spot of the fluorescent lamp of this type has not yet been fully studied.

According to the present invention, as a result of measuring the relation between the temperature of the coldest spot of a low-pressure mercury vapor discharge lamp having a double tube structure and the luminous efficacy thereof, it has been found that the temperature of the coldest spot of the tube associated with the maximum luminous efficacy, unlike the temperature of 37° C. to 44° C. for the ordinary tubular fluorescent lamp, lies in the range between 45° C. and 65° C.

DETAILED DESCRIPTION

Figure 1:
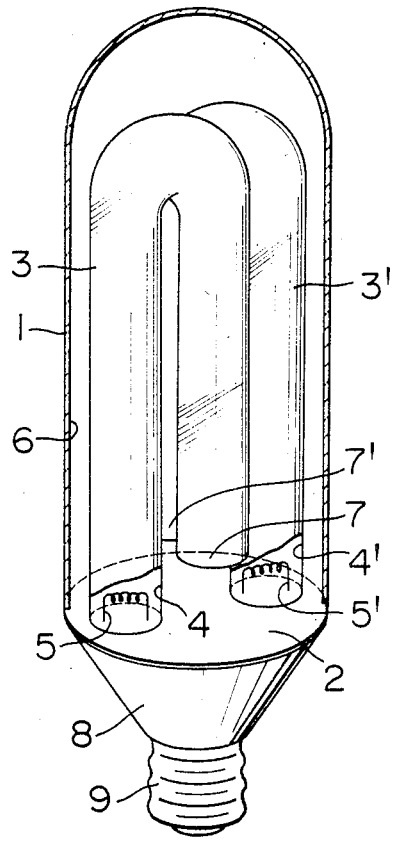
FIG. 1 PRIOR ART
FIG. 1 is a diagram showing the basic construction of a conventional compact fluorescent lamp.
Figure 2:
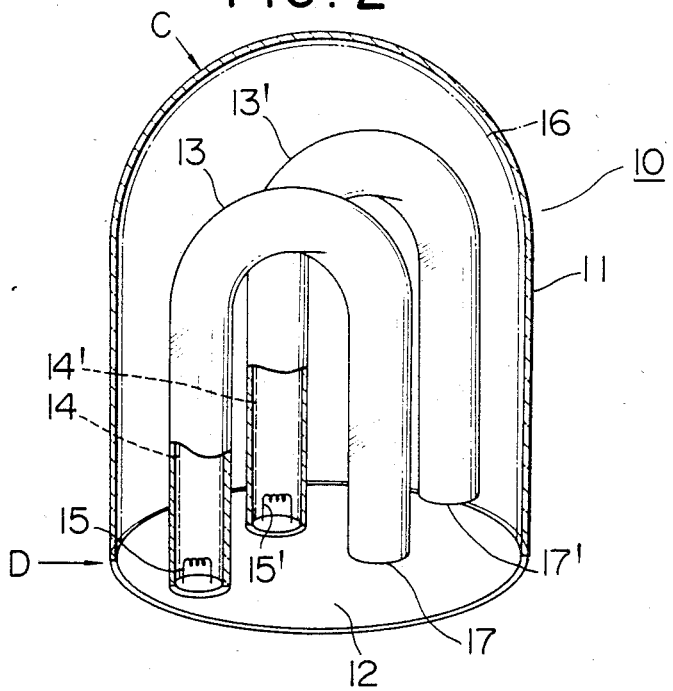
FIG. 2 is a diagram showing the basic construction of a compact fluorescent lamp according to the present invention.

As shown in FIG. 2, a compact fluorescent lamp 10 has a double tube structure comprising a tubular closed elongated glass lamp envelope 11 and a pair of inner tubes 13, 13' disposed in the envelope 11, with each end thereof being sealed at one end 12 of the envelope 11 and the each other end thereof being provided with openings 17, 17' which open into the space limited by the lamp envelope 11. The envelope 11 is filled with a rare gas such as Ar gas of several Torr and a small amount of mercury. Electrodes 15, 15' are disposed on the sealed end side in the inner tubes 13, 13'. Discharge is effected between the electrodes 15 and 15' by way of the inner tubes 13, 13' and the openings 17, 17', with the discharge generating ultraviolet rays which are converted into a visible light by phosphor layers such as of rare earth provided on the inner wall of the inner tubes 13, 13'. The inner wall of the closed envelope 11 carries a light-dispersing layer 16 such as of titanium oxide for preventing the dazzle of the light generated by the inner tubes 13, 13'. An operating circuit, not shown, is contained in a base 8 (FIG. 1) under the end 12 of the envelope 11, which base 8 has an end provided with a threaded sleeve 9 (FIG. 1).

So far as the foregoing description is concerned, there is no basic difference between the conventional fluorescent lamp shown in FIG. 1, and the fluorescent lamp according to the present invention.

The feature of the present invention, however, resides in that the coldest spot of the envelope 11 of a low-pressure mercury vapor discharge lamp as shown in FIG. 2 is set in the temperature range between 45° C. and 65° C. at the ambient temperature of 25° C. to thereby maintain the luminous efficacy of the lamp at 90% or more of the maximum efficacy.

The results of experiments are described below.

Figure 3:
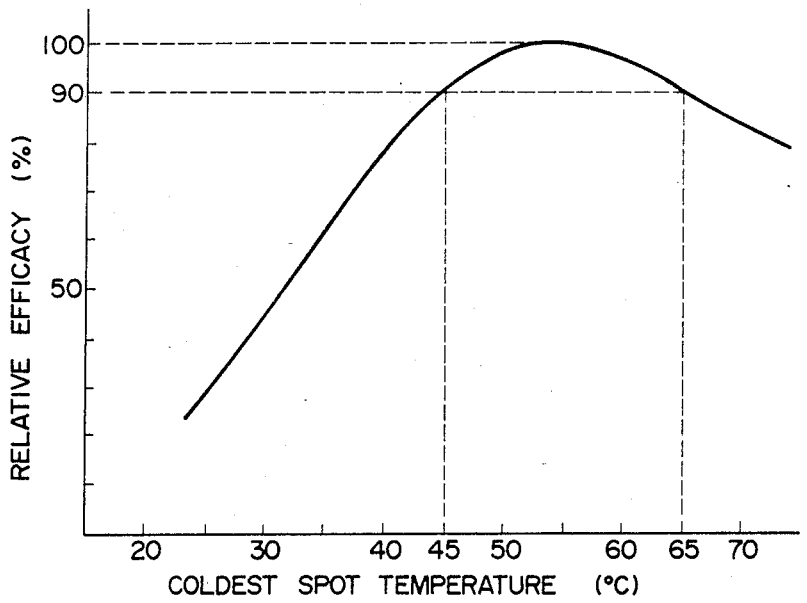
FIG. 3 is a graph showing the relation between the temperature of the coldest spot and the relative efficacy.

As evident from the graph of FIG. 3, the lamp efficiency as expressed by the relative efficacy reaches 90% or more of the maximum lamp efficacy as 100% at the temperature of 45° C. to 65° C. of the coldest spot of the closed envelope 11. This optimum temperature range of the coldest spot of the envelope 11 remains the same also for an envelope in the shape of the globe. This temperature range of the coldest spot of the envelope, which is approximately 15° C. higher than the average value for the conventional fluorescent lamps ranging from 37° C. to 44° C., is beyond the common sense of ordinary fluorescent lamps.

This is presumably attributable to the lamp construction in which the greater portion of lamp power is consumed in the inner tubes 13, 13' and further, the inner tubes 13, 13' are heat-insulated by the envelope 11.

Measurements show that the temperature of the inner tubes 13, 13' of the lamp turned on with lamp power of 20 W reaches as high as over 200° C. Even though the mercury vapor pressure determined by the temperature of the coldest spot in the inner tubes and the envelope 13, 13' and 11 coincide with each other, therefore, the density of mercury atoms N on which the lamp efficacy depends is lower in the inner tubes 13, 13' high in temperature than in the space between the inner tubes 13, 13' and the envelope 11, as seen from equation (1). Equation (1) indicates that the density difference corresponds to about 7° C. of the temperature at the coldest spot. This is considered one of the causes of the optimum temperature of the coldest spot being higher in the lamp structure shown in FIG. 2 than in ordinary fluorescent lamps.

In designing the lamp having the construction shown in FIG. 2, it is desirable to set the temperature of the coldest spot in operation at the level associated with the maximum lamp efficacy, that is, at about 54° C. From a more practical point of view the lamp efficacy 90% or more of the maximum lamp efficacy is attained if the temperature of the coldest spot is set at a level between 45° C. and 65° C.

Figure 4:
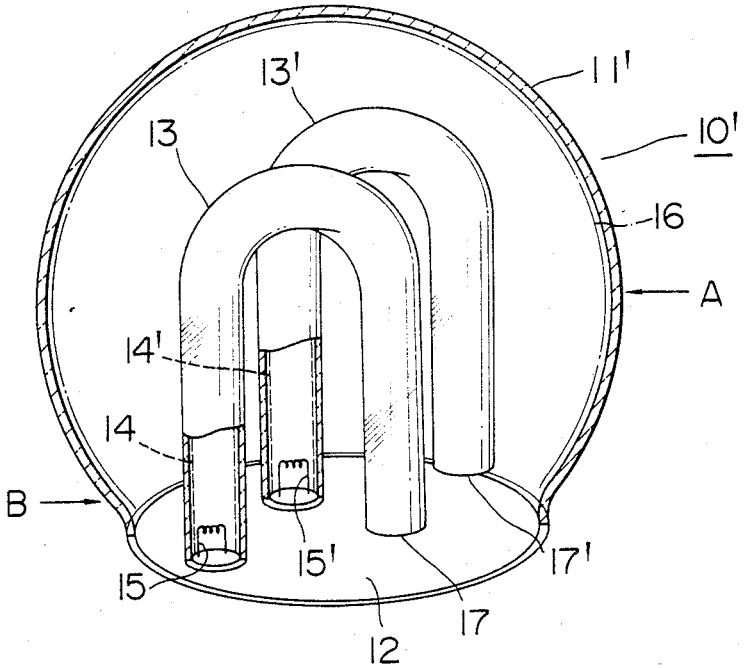
FIG. 4 shows the basic construction of another embodiment of the present invention.
Figure 5:
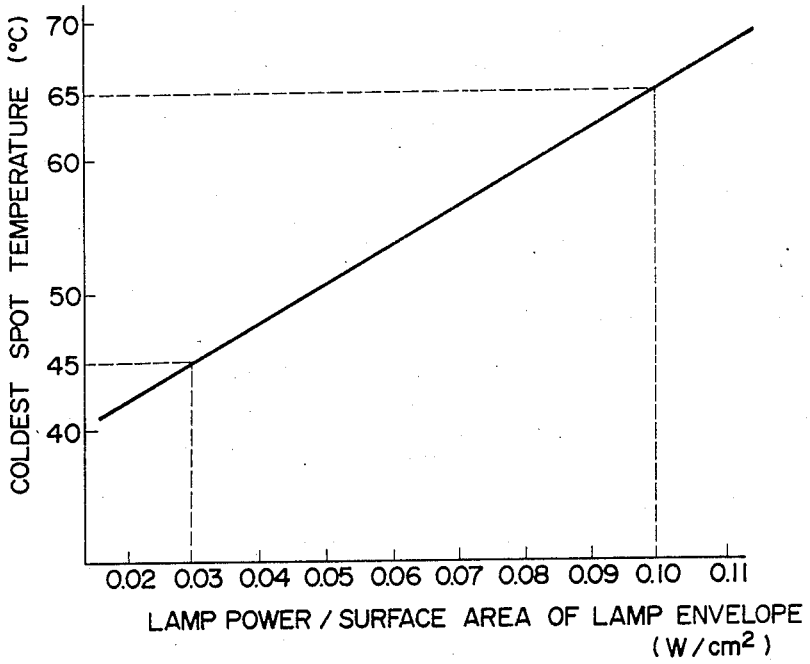
FIG. 5 is a graph showing the relation between the temperature of the coldest spot and the ratio between the lamp power and the surface area of the envelope.

Now, explanation will be made of specific means for setting the temperature of the coldest spot of the envelope 11 at a level between 45° C. and 65° C. As shown in FIG. 4, the surface temperature of the globe-shaped envelope 11' of the fluorescent lamp 10' is substantially uniform. This is primarily due to the heat conduction and the convection of the sealed gas. In this case, the temperature of the coldest spot is determined by the lamp power and the size of the envelope 11', namely, the surface area thereof. FIG. 5 shows the relation between the lamp power per unit surface area of the envelope 11' and the temperature of the coldest spot of the envelope in the construction of FIG. 4. As seen from the graph of FIG. 5, the temperature of the coldest spot of the envelope 11', in the range from 45° C. to 65° C., is obtained by setting the lamp power per unit surface area of the envelope 11' at a value between 0.03 $W/cm^2$ and 0.10 $W/cm^2$.

This value also applies to the fluorescent lamp 10 having an envelope 11 shaped in globe as shown in FIG. 2.

As shown in FIG. 4, the fluorescent lamp 10' comprises a globe-shaped envelope 11' having a diameter of 10 cm and a pair of U-shaped glass tubes 13, 13' having an inner diameter 10.7 mm and a length of 130 mm with the value of power for unit surface area of the envelope 11' being 0.064 $W/cm^2$. The coldest spot of the lamp of FIG. 4 occurs at the point A on the side of the globe and stands at 54° C. (with the ambient temperature of 25° C.). The difference between the temperature of the coldest spot A and the maximum temperature B of the surface of the envelope 11' is not more than five degrees except for local points. In this case, the total luminous fluxes of 805 lumen of the lamp 10' is involved and are reduced by about 10% with a change of ±10° C. in ambient temperature.

Now, assume that, as shown in FIG. 2, the envelope 11 takes a tubular shape of, for example, 7 cm in diameter, and a length of, for example, 12 cm long, while the inner tubes 13, 13', etc. remain the same as in the embodiment of FIG. 4. The coldest spot of the envelope 11 changes to the top at point C, and the temperature difference between the coldest spot and the point of highest temperature at point D, except for local high-temperature points, increases to about seven degrees. Nevertheless, the temperature of the coldest spot remains at 54° C., and the luminous fluxes (805 lumen for the ambient temperature of 25° C.) are reduced with a change of ambient temperature upward or downward.

It will be understood from the foregoing description that according to the present invention there is provided a low-pressure mercury vapor discharge lamp of a double tube structure wherein the lamp efficacy equivalent to 90% or more of the maximum lamp efficacy is attained by setting the temperature of the coldest spot on the surface of the envelope at a level between 45° C. and 65° C. at the ambient temperature of 25° C.

The temperature of the coldest spot associated with the maximum lamp efficacy vaires with the diameter of the inner tube. Experiments with an inner tube having a diameter of 8 to 16 mm which is considered suitable for the compact fluorescent lamp, however, show that even though the peak value of the graph in FIG. 3 somewhat changes laterally, substantially the same high lamp efficacy is obtained by maintaining the temperature of the coldest spot between 45° C. and 65° C.

We claim:

1. A low-pressure mercury vapor discharge lamp comprising an envelope forming a gas-tight closed space, a pair of inner tubes provided in said gas-tight closed space and having an end sealed at the first end of said envelope, the other end of said pair of inner tubes being opened in said gas-tight closed space, electrodes provided on the sealed end sides of said pair of inner tubes, and means for setting a value of lamp input power per unit surface area of said envelope in the range between 0.03 $W/cm^2$ and 0.10 $W/cm^2$ so that a temperature of a coldest spot of said envelope is in a range between 45° C. and 54° C. at an ambient temperature of 25° C.

2. A low-pressure mercury vapor discharge lamp comprising an envelope forming a gas-tight closed space, inner tube means provided in said gas-tight closed space for enabling discharge in said gas-tight closed space, said inner tube means having an opening for communicating a space in said inner tube means with said gas-tight closed space, and means for setting a value of lamp input power per unit surface area of said envelope in the range between 0.03 $W/cm^2$ and 0.10 $W/cm^2$ so that a temperature of a coldest spot of said envelope is in a range between 45° C. and 65° C. at an ambient temperature of 25° C.

3. A low-pressure mercury vapor discharge lamp according to claim 2, wherein said inner tube means includes at least one tube member, the at least one tube member having one end sealed at a first end of said envelope, and electrode means provided in said at least one tube member.

4. A low-pressure mercury vapor discharge lamp according to claim 3, wherein said at least one tube member is a U-shaped glass tube.

5. A low-pressure mercury vapor discharge lamp according to claim 2, wherein said envelope is one of a globe-shaped glass envelope and a tubular glass envelope.

* * * * *

UNITED STATES PATENT AND TRADEMARK OFFICE

CERTIFICATE OF CORRECTION

PATENT NO. : 4,587,453

DATED : May 6, 1986

INVENTOR(S) : ONO et al

It is certified that error appears in the above—identified patent and that said Letters Patent is hereby corrected as shown below:

IN THE CLAIMS:

Column 5, line 25, delete "54°" and insert --65°--;

Signed and Sealed this

Twenty-third Day of December, 1986

*Attest:*

DONALD J. QUIGG

*Attesting Officer* *Commissioner of Patents and Trademarks*